United States Patent [19]

Kawakami et al.

[11] 4,085,237

[45] Apr. 18, 1978

[54] METHOD AND APPARATUS FOR MANUFACTURING PRESSURE SENSITIVE COPYING SHEET

[75] Inventors: Takajiro Kawakami; Minesilo Mizuno; Akira Okushi; Michio Yasuda, all of Amagasaki, Japan

[73] Assignee: Kanzaki Paper Manufacturing Co., Ltd., Tokyo, Japan

[21] Appl. No.: 613,508

[22] Filed: Sep. 15, 1975

[30] Foreign Application Priority Data

Sep. 17, 1974 Japan ..... 49-107317
Sep. 20, 1974 Japan ..... 49-108981

[51] Int. Cl.[2] ..... B41M 5/22; B05C 9/04; B05C 9/14

[52] U.S. Cl. ..... 427/150; 118/60; 118/67; 118/69; 427/152; 427/361; 427/366; 427/382

[58] Field of Search ..... 427/150, 152, 361, 364, 427/365, 366, 382; 118/67, 60, 69, 223

[56] References Cited

U.S. PATENT DOCUMENTS

| | | | |
|---|---|---|---|
| 2,920,698 | 1/1960 | Hornbostel | 118/60 X |
| 3,110,612 | 11/1963 | Gottwald et al. | 118/60 X |
| 3,222,209 | 12/1965 | Brundige et al. | 427/364 |
| 3,632,378 | 1/1972 | Busch | 427/150 |
| 3,773,545 | 11/1973 | Erb et al. | 427/366 X |

*Primary Examiner*—John P. McIntosh
*Attorney, Agent, or Firm*—Armstrong, Nikaido, Marmelstein & Kubovcik

[57] ABSTRACT

The continuously fed paper sheet is subjected to the successive steps of coating an acceptor composition at its one side, drying, calendering with a calender comprising a metal roll and an elastic roll having a Shore hardness within the range of 65 to 90, further coating a color former composition on the other side and further drying. The continuously fed paper sheet may be subjected to a cylinder ironing treatment between the first drying step and the calendering step.

6 Claims, 2 Drawing Figures

METHOD AND APPARATUS FOR MANUFACTURING PRESSURE SENSITIVE COPYING SHEET

BACKGROUND OF THE INVENTION

This invention relates to the method and apparatus for manufacturing a kind of pressure sensitive copying sheet specially of two side coated pressure sensitive copying sheet.

Usually the so-called "pressure sensitive copying sheet" consists of these three kinds of basic sheets such as top sheet, middle sheet, and bottom sheet, wherein the top sheet is coated on the underside thereof with a composition consisting mainly of pressure-rupturable microcapsules each enclosing a hydrophobic substance containing an electron donating organic chromogenic material (hereinafter referred to as "color former") as dissolved or dispersed therein, the middle sheet is coated on the upperside thereof with another composition consisting mainly of electron accepting acidic reactant material (hereinafter referred to as "acceptor") which will produce a colored image when contact with the color former and also is coated on the lowerside thereof with the composition of color former, and the bottom sheet is coated on the upperside thereof with the composition of acceptor. Thus, any partial pressing on the upperside of top sheet with a pen or a typewriter will break the microscopic capsules positioned on the pressing, resulting in making the color former react with the acceptor so as to develop a colored image only on the part pressed. One top sheet, at least one middle sheet and one bottom sheet are supperposed in that order to form a set of copying sheet in such a manner that the color former coating layer and the acceptor layer are in contact with each other in each ajoining two sheets. Any partial pressing on the upperside of the top sheet of the thus prepared copying system with a pen or a typewriter will break the microcapsules positioned on the pressing, resulting in making the color former react with the acceptor so as to develop a color only on the part pressed.

As the color former is generally very expensive, it is desired to effectively utilize the color former to the utmost extent by making the surface applied with the acceptor as smooth as possible, thereby obtaining sensitive contact between the color former and the acceptor. It is also desirable to make the surface applied with the color former smooth as well as in the surface applied with the acceptor mentioned above and besides deposit the color former as even as possible relatively on the part near the surface of the sheet without allowing the color former to permeate deeply into the sheet.

In order to meet the above requirement it is known to carry out such a process in the manufacture of the middle sheet that firstly the paper sheet is applied with the acceptor on the upperside thereof and then it is passed through a calender so as to make smooth the surface applied with the acceptor and at the same time to reduce porous spaces in the sheet prior to application of the color former on the underside thereof as the next process.

The conventional process in which the application of acceptor, the smoothing of the applied surface, and the application of color former are separately carried out with the use of the respective devices, therefor independently located involves many disadvantages such as intricacy of the process, much labors required, much space required, conveying means required and gauges required etc.

Recently, a successive coating apparatus including a first coater for the acceptor, a first dryer, a calender, a second coater for the color former and a second dryer was proposed, e.g. as disclosed in U.S. Patent Specification No. 3,632,378 granted to Thomas W. Busch and Japanese Laid-Open Publication No. 37,213 of 1973. This successive coating apparatus involves another disadvantages because the calender included in that apparatus is the so-called machine calender which consists solely of a plurality of metal rolls (chilled rolls). The calendering of the sheet applied with the acceptor by passing it through the nip between one metal roll and the other metal roll is effective to increase the density of the sheet by decreasing porous spaces in the sheet but on the other hand it is not so effective to obtain a complete smoothness of the surface of the sheet since the so-called "chilled marks (calender spots)" are produced all over the surface of the sheet. This will result in not only degrading the appearance of the surface but also causing the desensitizer printed on the surface of acceptor's layer to be extremely uneven resulting in showing an uneven and unsatisfactory desensitizing effect. In order to improve such an uneven smoothness of the surface of the sheet, the number of the nip in the machine calender, the pressure applied and/or the moisture content of the sheet may be increased. Such measures would, however, give a severe load on the sheet of a light weight, resulting in bringing about such unfavorable phenomena on the works as the breaking and wrinkling of the sheet and besides making it impossible to operate the apparatus with a high speed. In addition, since the metal rolls will accompany with heating thereof up to a considerably high temperature during the operation, it will cause relatively thermoplastic acceptor compositions such as those of phenol type and aromatic carboxylic acid type etc. cojointly with the thermoplastic binder of synthetic resin latex to adhere to the metal rolls, resulting in these troubles such as the breaking and wrinkling of the sheet and also uneven color developing and bleeding due to some mechanical and chemical deterioration of the acceptor used.

Further each of the metal rolls in the machine calender is usually provided with a crown to absorb any deformations of the metal rolls under pressure. It is however extremely difficult to form the crown in such a manner that it can respond fully to any changes in the pressing condition. Accordingly the calendering conditions vary during operation at a high speed with the result in producing papers having an uneven thickness and wavy edges.

The primary object of the invention is to provide an improved method for the manufacture of a pressure sensitive copying sheet in which a two side coated middle sheet having a uniform acceptor layer and a uniform color former layer at its opposite sides can be continuously manufactured at a high rate and at a high efficiency.

Another object of the invention is to manufacture the two side coated middle sheet having a good appearance and an excellent performance of color development.

A further object of the invention is to provide a method for the manufacture of a pressure sensitive copying sheet in which various kind of acceptor compositions can be utilized.

A still further object of the invention is to provide an improved apparatus carrying out the method mentioned above.

Other objects and advantages of the invention will become apparent from the following description.

SUMMARY OF THE INVENTION

According to the invention a pressure senstive copying sheet having an acceptor coating on one side and a color former coating on the opposite side is manufactured by the sequential steps of coating an acceptor composition on one side of a continuously fed paper sheet, drying the paper sheet coated with said acceptor composition, calendering the dried sheet with a calender comprising at least one pair of rolls, one of said pair of rolls being a metal roll and the other being an elastic roll having a Shore hardness within the range of 65 to 90, preferably within the range of 78 to 85, coating a color former composition on the other side of said paper sheet, and drying the paper sheet coated with said color former composition.

In a preferred embodiment of the invention, a cylinder ironing step is inserted between the first drying step and the calendering steps. Means for carrying out the cylinder ironing step may comprise a rotating cylindrical drum with a heater and an endless belt which is pressed at a stretched portion thereof along the peripheral direction of the drum toward the drum so that the endless belt may be moved with the rotating drum.

In a further embodiment of the invention, a cylinder cooling step is inserted between the first drying step and the calendering step in combination with the cylinder ironing step whether before or after the cylinder ironing step. Means for carrying out the cylinder cooling step may be of a substantially similar construction to that for the cylinder ironing except that cooling means is used instead of a heater.

BRIEF DESCRIPTION OF THE DRAWINGS

Throughout FIGS. 1 and 2, like reference numerals indicate like parts.

PREFERRED EMBODIMENT OF THE INVENTION

Figure 1:
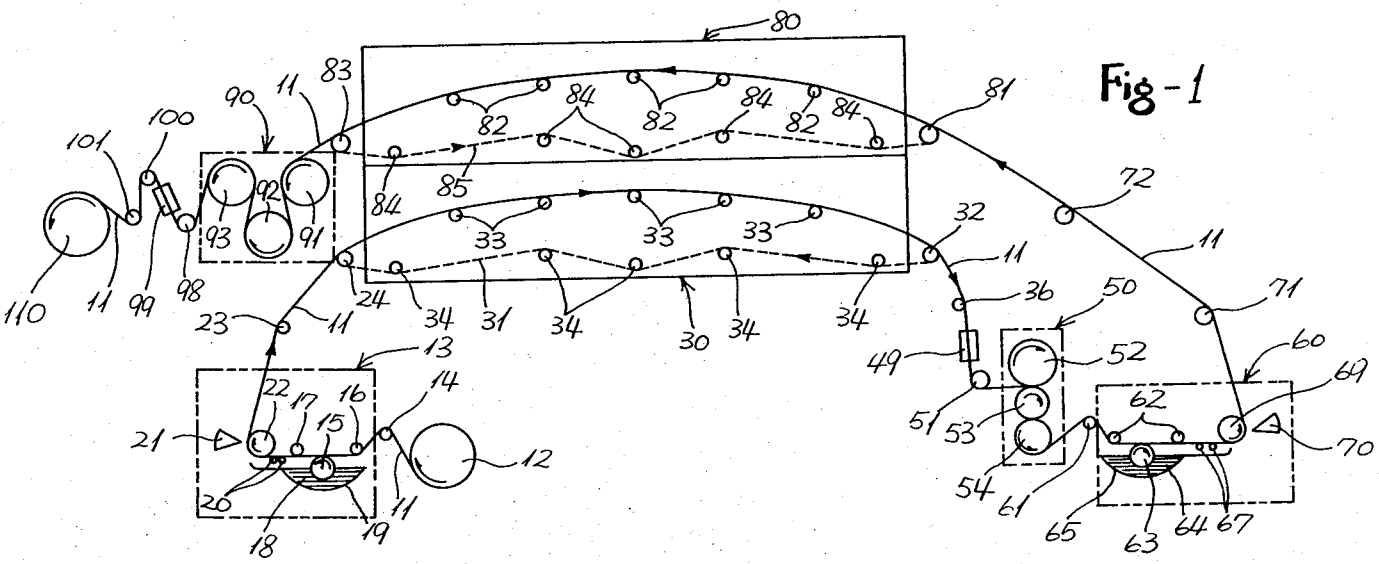
FIG. 1 is a schematic elevational view of a coating machine embodying the invention.

Referring now to the drawings, especially to FIG. 1, the base paper sheet 11 is unwound from a supply roll 12 to enter into an air knife coater generally indicated as 13 through a tension roller 14. The air knife coater 13 is the first coater for coating an acceptor composition. In the air knife coater 13, the paper sheet is in contact with an application roller 15 by means of press rollers 16 and 17, whereby it is coated on one side thereof with the acceptor composition 18 contained in the coating liquid reservoir 19. Any excessive coating composition is removed from the surface by means of a pair of metering rods 20, which may be either of a wire wound type or of a non-wire wound type. The coated paper sheet is then fed to an air knife 21 cooperating with a backing roller 22, where the coating amount is adjusted, accompanied by smoothening the coated surface. The above mentioned metering rods 20 are not always necessary. However, they can play such roles as removing off any excessive coated liquid from the surface, metering the coating weight, and smoothening the coated surface prior to the air knife 21, resulting in reducing the amount of coat mist produced at the position of the air knife 21 and preventing uneven coating auxiliary. These effects and advantages are especially remarkable in the coating operation with a high speed.

In FIG. 1, an air knife coater is illustrated as the first coater. Although the air knife coater is most preferred as the coater head, it is not limited to the one. Any other kinds of coater heads which have been used up to today for the works of paper coating such as blade coaters and roll coaters etc. may also be used. The usual coating quantity of the acceptor composition on the sheet is about 2 to 20 g/m$^2$ on dry basis and preferably 4 to 13 g/m$^2$ on dry basis.

The acceptor composition may be of any conventional types. Among the typical acceptor compositions there may be included inorganic acceptors, such as acid clay, activated clay, atapulgite, zeolite, kaolin, bentonite, and silicates; organic acceptors such as phenol-formaldehyde polymers, phenol-acetylene polymers, maleic acid rosin resin, ethylenemaleic acid anhydride polymers, salicylic acid-aldehyde polymers, salicylic acid-acetylene polymers, polyhydric metal's salts of those polymers mentioned above, aromatic carboxylic acids such as salicylic acid or salicylic acid's derivatives, and polyhydric metal's salts of aromatic carboxilic acids; and various combinations of the organic acceptors mentioned above with metal oxides, metal hydroxides, metal carbonates, e.g., zinc oxide, aluminium hydroxide and zinc carbonate etc., and/or the above mentioned inorganic acceptors. In case where the acceptor composition consists of much the combination of an organic acceptor compound with at least one of metal compound and inorganic acceptor compound, the amount of the organic acceptor component may preferably be within the range of 2 to 100 parts by weight on dry basis with respect to 100 parts of the inorganic and/or metal compound component.

The wet base sheet applied with the acceptor coating composition in the first coater 13 is then forwarded into a tunnel dryer generally indicated by the reference numeral 30 after being guided by means of the guide rollers 23 and 24. The tunnel dryer 30 is the first dryer according to the invention. In the tunnel dryer 30, the coated sheet is dried while it is fed by means of an air pervious endless belt 31 stretched between two rollers 24 and 32 through a number of guide rollers 33. The reference numeral 34 indicates a number of guide rollers for the return passage of the endless belt 31.

Although the tunnel dryer of the belt-conveyor type as shown in the drawing is the most suitable as the first dryer for the purpose of drying a wet sheet having a relatively light weight, it is not limited to that one and it is possible to utilize it in combination with any other dryers such as an infrared dryer etc. as the first dryer. As for the detailed structure of the tunnel dryer of the conveyor type, for example, reference may be made to U.S. Patent Specification No. 3,311,499.

The sheet leaving the first dryer 30 is then introduced to a calender generally indicated by the reference numeral 50 through guide rollers 36 and 51. If the sheet is overdried in the first dryer, it is possible to utilize a suitable moistening device 49 such as paper master conditioner manufactured by Easton Johnson Ltd. and Greenbank Engineering Co., Ltd. of United Kingdom to moisten the sheet to a paper moisture content, for example, within the range of 3% to 8% by weight before entering into the calender 50.

The calender 50 may be most preferably a super calender which consists of an elastic roll 53 and two metal rolls 52 and 54 in combination. The Shore hardness of the elastic roll 53 may be e.g. 81. It should, however, noted that the number of the rolls or nips is not limited to that illustrated in the drawings and any other calenders than the super calenders may also be used, so far as they consist of a combination of at least one elastic roll and at least one metal roll. Among those other calenders there are included multi stack e.g. 10 to 15 stacks super calenders, thermo-planishers disclosed in "Pulp and Paper" June 10, 1968, pp 32, 33 and gloss calenders.

As for the metal roll the so-called "chilled roll" made of cast iron is preferably used. However, it is possible to use other metal rolls such as rolls made of alloys including nickel and/or chrome, steel rolls, rolls whose surface is plated with hard chrome. The metal roll may also be provided with a heater or cooling device therein. In order to control the thickness of the paper sheet it is also preferred to use the so-called "swimming roll" of which the crown can be controlled at will as by means of hydraulic pressure.

The hardness range of the elastic roll is critical and important. If the Shore hardness of the elastic roll is larger than 90, the desired surface smoothness of the paper sheet after calendering cannot be expected and the elastic roll is easily injured. If the Shore hardness of the elastic roll is lower than 65, the desired surface smoothness of the paper sheet after calendering cannot be obtained as well and the elastic roll is easily damaged by heat during the operation. Accordingly, the elastic roll should have a Shore hardness within the range of 65 to 90, preferably 78 to 85. The definition of the Shore hardness is given by Type D Shore Durometers according to ASTM Standard D-2240.

The elastic roll may be made of any elastic material such as cotton, wool, paper, asbestos, hard rubber and etc. Among them, cotton, wool, paper and asbestos are preferred from the viewpoint of obtaining a smooth surface by grinding.

The diameter of the metal roll and the elastic roll may be determined depending on the number of rolls, base paper sheet width and the material of the rolls. Generally, it will be within the range of 20 to 100 cm.

The nip pressure between the metal roll and the elastic roll may also be determined depending on the properties of the paper sheet and the feeding speed. Generally, it will be within the range of 40 to 400 kg/cm, preferably 100 to 300 kg/cm.

The calendered paper sheet is then introduced through a tensioning roll 61 into the second coater generally indicated by the reference numeral 60. In the second coater 60 which may be an air knife coater, the paper sheet is pressed against the applicator roll 63 by means of press rolls 62, whereby it is coated on the other side thereof with the color former composition 64 in the coating liquid reservoir 65. Any excessive coating composition is removed from the coated surface by means of a pair of metering rods 67. The metering rods may be either of a wire wound type or of a non-wire wound type. The coated paper sheet is then fed to an air knife 70 cooperating with a backing roller 69, where the coated quantity per unit square is adjusted, accompanied by smoothing the coated surface. The above mentioned metering rods 67 are not always necessary as well as the metering rods 20 in the first coater 13.

The color former composition may be prepared by any conventional methods. According to the method disclosed in the U.S. Patent Specification No. 2,800,457, each of the microcapsules contains a non-volatile oil droplet in which a color former is dissolved or dispersed. Among the color formers there may be included lacton dyes such as crystal violet lacton, malachite green lacton, rhodamine lacton, methylene blue dyes such as benzoyl leucomethylene blue, fluoran derivatives such as 3-diethylamino-7-benzylaminofluoran, 3-diethylamino-7-aminofluoran, 3,7-bisdiethylaminofluoran, spiropyran compounds such as benzo-$\beta$-naphthospiropyran, 6'-nitro-1,3,3-trimethylspiropyran and leuco auramine compounds such as 1-[bis-(p-dimethylaminophenyl)-methyl]-pyrolidine, 1-[bis-(p-dimethylaminophenyl)-methyl]-piperidine. Among the useful non-volatile oils there are included alkylnaphthalene, alkylbiphenyl, triallyldimethane, kerosene and etc. The amount of the color former composition to be applied to the paper sheet is usually within the range of about 2 to 15 g/m$^2$ on dry basis, preferably within the range of about 3 to 10 g/m$^2$ on dry basis.

The paper sheet coated with the color former composition is then introduced to the second dryer through a number of guide rollers 71, 72 and 81. In the embodiment illustrated in the drawings the second dryer comprises a combination of a tunnel dryer 80 and a drum dryer 90. In the second tunnel dryer 80 the coated sheet is dried while it is fed by means of an air-pervious endless belt 85 stretched between two rollers 81 and 83 through a number of guide rollers 82. The reference numeral 84 indicates a number of guide rollers for the return passage of the endless belt 85. The tunnel dryer 80 may be of a construction similar to the tunnel dryer 30 as described before.

The paper sheet leaving the tunnel dryer 80 is then introduced to a drum dryer generally indicated with the reference numeral 90. The drum dryer 90 may consist of three cylindrical drums 91, 92 and 93 each having its own heater. The paper sheet leaving the second dryer assembly is rewound by a rewinding roll 110 after passing through guide rollers 98, 100 and 101. If necessary the paper sheet is moistened by a suitable moistening device 99 before being rewound.

An air knife coater is the most preferably used as a coater head in the second coater just like the case of the first coater. In addition, for example, a blade coater, a roll coater and etc. which are conventionally used in paper coating process as a coater head can be used. Moreover the combination of the tunnel dryer and the drum dryer shown in the drawings is preferably used as the second dryer, however it is not limited to this combination, but a combination with well known dryers like an infrared dryer and etc. may be adopted at will.

Figure 2:
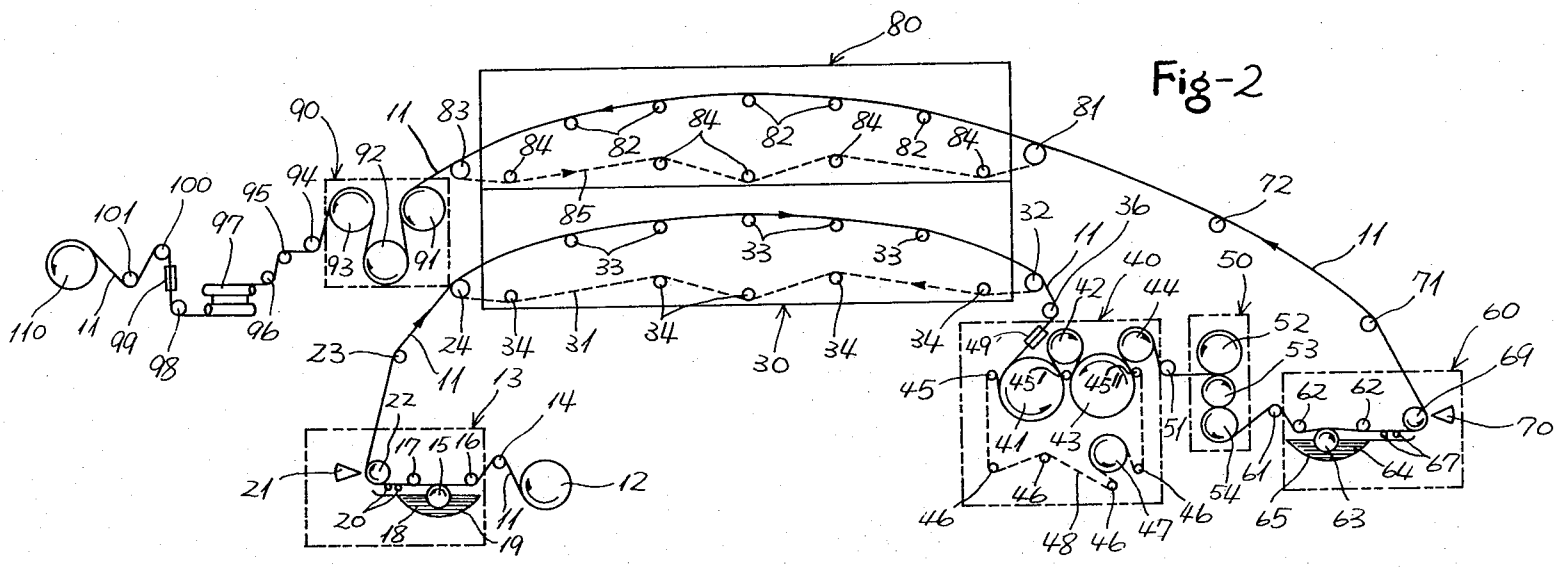
FIG. 2 is a schematic elevational view similar to FIG. 1 of another coating machine illustrating another embodiment of the invention.

FIG. 2 illustrates another embodiment of the invention which is similar to that illustrated in FIG. 1 except the provision of a cylinder assembly which is generally indicated by the reference numeral 40. The coating machine illustrated in FIG. 2 includes a paper sheet supply roll 12, a first coater 13, a first dryer 30, a cylinder assembly 40, a calender 50, a second coater 60, a second dryer system 80 and 90 and a rewinding roll 110. The like reference numerals in FIGS. 1 and 2 indicate like parts.

The paper sheet 11 unwound from the supply roll 12 is coated at its one side with an acceptor coating by the first coater 13 and then dried by the first dryer 30 in the same manner as described before referring to FIG. 1.

According to the embodiment illustrated in FIG. 2, the paper sheet leaving the first dryer 30 is introduced into the cylindrical assembly 40 before entering into the calender 50. The reference numeral 36 indicates a guide roller positioned between the first dryer 30 and the cylinder assembly 40.

The cylinder assembly comprises four cylindrical drums 41, 42, 43 and 44 and an endless canvas 48. The endless canvas 48 is pressed at two stretched portions between two guide rollers 45 and 45' and between two guide rollers 45' and 45" thereof along the peripheral directions of the drums 41 and 43 to the respective drums 41 and 43 so that the endless canvas 48 may be moved along with the rotating drums 41 and 43. The reference numeral 46 indicates the guide rollers in the return passage of the endless canvas 48.

The paper sheet is advanced along the surfaces of the drums 41, 42, 43 and 44 successively in that order. The drums 41, 42, 43 and 44 may be provided with a heater. In this manner, the paper sheet is subjected to a cylinder ironing treatment while it is fed along and in close contact with the surface of the drums with the aid of the endless canvas which is pressed toward the drums 41 and 43. The number of drums is not particularly limited but changeable depending on the diameter of drums, the operating speed and etc. It is advantageous to plate, for example, hard chrome to the drum surface in order to obtain the good surface smoothness. Moreover, the drums may be provided with cooling means in addition to a heater so that either cooling means or heater may be selectively used. For example, in the drawings, the paper sheet is subjected to the cylinder ironing treatment by means of heating drums 41, 42 and 43 and cooled by cooling drum 44 before being forwarded to the calender 50 so that the calender rolls may be prevented from over heating which causes adhesion of the coated surface of the base sheet to the calender rolls and damages the elastic roll by heat.

The endless canvas 48 may preferably be dried by the dryer 47 in its return passage to keep it always in a dried state so that local concentration of moisture may be removed. This would be especially advantageous in a high speed operation.

According to the invention any puckers, curls and cockles existing in the paper sheet after leaving the first dryer can be smoothened off due to the cylinder ironing effect by the heated drums. This is quite important to prevent the paper sheet from being wrinkled when it is subjected to a calendering treatment at the calender 50. This is also advantageous in that since no wrinkles exist in the paper sheet when it is introduced to the calender, the elastic roll 53 in the calender will never be injured by wrinkles of the paper sheet. This will also result in making it possible to operate the whole system at a high speed.

In case where the cylinder assembly 40 described is arranged between the first dryer 30 and the calender 50, it is not necessary to completely dry the paper sheet coated with the acceptor composition by the first dryer 30. It is rather desired that the paper sheet entering into the cylinder assembly 40 has a relatively high moisture content, although the moisture content must be controlled within such a range that the coating layer on the paper sheet is not offset and adhere to any of the cylindrical drums. For example, the moisture content of the paper sheet entering into cylinder assembly may be controlled within the range of 7 to 11% by weight. In case where the paper sheet is overdried by the first dryer 30, it is possible to moistening it by a suitable moistening means such as paper master conditioner mentioned before. The reference numeral 49' indicates a moistening means positioned immediately before the cylindrical drum 41.

The paper sheet leaving the cylinder assembly is subjected to the calendering treatment with the calender 50, the coating with the color former coating composition by the second coater 60, the drying treatment by the second dryer system 80 and 90 in substantially the same manner as described before referring to FIG. 1.

The dried sheet leaving the drum dryer 90 is advanced through guide rollers 94, 95 and 96 to turning-over means 97 at which the sheet is turned upside-down so as to make the side coated with the color former to the underside thereof. This turning-over means is not always used but utilized only when it is required to turn over the sheet. The product sheet is then rewound on the rewinding roll 110 after passing through a number of guide rollers 98, 100 and 101. If required, the paper sheet may be moistening by suitable moistening means 99 before being rewound. Any further modifications may be introduced with respect to detailed constructions of the manufacturing apparatus. For example, an endless canvas may be included in the second drum dryer and cooling rolls and expander rolls may be included at paper positions in the coater machines illustrated in the drawings.

According to the invention various new advantages can be obtained. The calendering step with the use of a metal roll and an elastic roll in combination is not only to change a porous structure of the paper sheet to a dense structure but also to prevent production of the so-called "chilled marks" which is inevitable with the use of a machine calender consisting solely of metal rolls. The coated surface of the paper sheet which has been in contact with the surfaces of metal rolls is fairly smoothened and flattened. The opposite surface of the paper sheet having no coating at this stage is also substantially smoothened so that an excess impregnation of the color former coating composition which is applied in the next step can be prevented. This will participate in obtaining a uniform and smooth color former layer. In case of a super calender utilizing a metal roll and an elastic roll according to the invention, the conditions for calendering with respect to the number of nips and the moisture content of the paper are not so hard in comparison with the case of utilizing a machine calender which consists solely of metal rolls. Accordingly such troubles as breaking and wrinkling can be substantially avoided, allowing a high speed operation of the machine.

As already mentioned before, the combination of the cylinder assembly with the super calender having a metal roll and an elastic roll is also important. According to the invention any puckers, curls and cockles can be smoothened off due to the cylinder ironing effect by the cylinder assembly so that the paper sheet may be prevented from production of wrinkles in the calendering step. It is well known that if any wrinkles are produced in the paper sheet, they will take scratches on the surface of the elastic roll of the calender which will in turn impart permanent lines or patterns to the paper sheet.

The utilization of the calender having an elastic roll and a metal roll enables to widely use organic acceptors which are usually thermoplastic. If the acceptor composition includes a thermoplastic material whether as a main acceptor component or as a resin latex binder, the acceptor layer on the paper sheet will be offset and adhered to the surface of the calender rolls when a machine calender is used such a hard condition as causes plasticization of the thermoplastic material. Adhesion of the acceptor coating to the calender rolls will cause to break the paper sheet and to produce wrinkles. To the contrary, according to the invention, since the calender consists of at least one elastic roll and at least one metal roll, such severe and hard conditions as required in case of a machine calender are not required. Accordingly adhesion of the color acceptor coating layer to the calender rolls can be substantially avoided, causing no trouble involved, even when the before mentioned organic acceptor compositions are used.

The thickness of a pressure sensitive copying paper must be strictly controlled since it is usually thin. In order to control the thickness of the paper within a strict range, various conditions for operation such as the feeding speed and the pressure applied in the calendering must also be strictly controlled. According to the invention most of undesirable variations in the feeding space and the pressure applied can be absorbed by the elasticity of the elastic roll so that the paper sheet may be prevented from being badly affected by those strict controlling operations.

What we claim is:

1. In a method for manufacturing a pressure sensitive copying sheet having an acceptor coating on one side and a color former coating on the opposite side, the steps, in the sequence set forth, of coating an acceptor composition on one side of a continuously fed paper sheet, drying the paper sheet coated with said acceptor composition, cylinder ironing said paper sheet to remove wrinkles, calendering the dried sheet with a calender comprising at least one pair of rolls, one of said pair of rolls being a metal roll and the other being an elastic roll having a Shore hardness within the range of 65 to 90, coating a color former composition on the other side of said paper sheet, drying the paper sheet coated with said color former composition.

2. A method for manufacturing a pressure sensitive copying sheet as defined in claim 1, in which said elastic roll has a Shore hardness within the range of 78 to 85.

3. A method for manufacturing a pressure sensitive copying sheet as defined in claim 1, still further including cylinder cooling step after said cylinder ironing step.

4. A method for manufacturing a pressure sensitive copying sheet as defined in claim 3, in which said elastic roll has a Shore hardness within the range of 78 to 85.

5. Apparatus for manufacturing a pressure sensitive copying sheet having an acceptor coating on one side and a color former coating on the opposite side which comprises a successive arrangement of:

a. a first coater for coating an acceptor composition on one side of a continuously fed paper sheet,
b. a first dryer for drying the paper sheet coated with said acceptor composition,
c. cylinder ironing means to remove wrinkles from the paper sheet, said cylinder ironing means comprising a rotating cylindrical drum with a heater and an endless belt which is pressed at a stretched portion thereof along the peripheral direction of said drum toward said drum so that said endless belt may be moved along with said rotating drum,
d. a calender for calendering the dried sheet, said calender comprising at least one pair of rolls, one of said pair of rolls being a metal roll and the other being an elastic roll having a Shore hardness within the range of 65 to 90,
e. a second coater for coating a color former composition on the other side of said paper sheet, and
f. a second dryer for drying the paper sheet coated with said color former composition.

6. Apparatus for manufacturing a pressure sensitive copying sheet as defined in claim 5, still further including cylinder cooling means at a position after said cylinder ironing means, said cylinder cooling means comprising a rotating cylindrical drum with cooling means.

* * * * *